United States Patent [19]

Komatsu

[11] 4,015,305

[45] Apr. 5, 1977

[54] MOP HOLDER

[75] Inventor: Toshiyoshi Komatsu, Osaka, Japan

[73] Assignee: Duskin Franchise Co., Ltd., Osaka, Japan

[22] Filed: Mar. 3, 1976

[21] Appl. No.: 663,442

[52] U.S. Cl. ..... 15/150; 15/229 A

[51] Int. Cl.[2] ..... A47L 13/255; A47L 13/258

[58] Field of Search ..... 15/147 C, 148, 150, 15/153, 178, 228, 229 A, 229 AW, 209 D

[56] References Cited

UNITED STATES PATENTS

| | | | |
|---|---|---|---|
| 2,464,509 | 3/1949 | Horwitz | 15/178 X |
| 2,994,096 | 8/1961 | Vaughn | 15/150 X |
| 3,605,161 | 9/1971 | Moss et al. | 15/150 |

FOREIGN PATENTS OR APPLICATIONS

| | | | |
|---|---|---|---|
| 22,501 | 9/1901 | Switzerland | 15/209 D |

*Primary Examiner*—Daniel Blum
*Attorney, Agent, or Firm*—Sherman & Shalloway

[57] ABSTRACT

A mop holder comprising a holding member for holding a mop formed of a synthetic resin having a high resistance to folding, a handle shaft and a linkage member for linking said holding member to the handle; wherein said holding member comprises a pair of shell members integrally formed of said synthetic resin and extending in the lengthwise direction, a hinge that links said pair of shell members so that they can be opened and closed, a pair of teeth trains to hold the mop, and a plurality of anchoring pins provided inside said shell members; the outer surfaces of said shell members are convex, said hinge is thinner than said shell members, and flexible and extending in the lengthwise direction; said pair of teeth trains are provided at the end of an extension plate bent inwardly from said shell members at the lower edge opposite to the hinge of said shell members and over the entire lengthwise direction thereof, so that said pair of teeth trains are disposed to face each other; said anchoring pins are arranged in the vicinity of both edges, in the lengthwise direction, of said shell members to protrude toward the inside of said shell members, so that when said pair of shell members are closed, the anchoring pins provided on each of the shell members are engaged with the mop alternately; a recessed groove is formed on the outer surfaces of said pair of shell members near said lower edge and at the central part in the lengthwise direction, said recessed groove being in parallel to said lower edge so as to mount thereon the linking member.

9 Claims, 8 Drawing Figures

Fig. 1
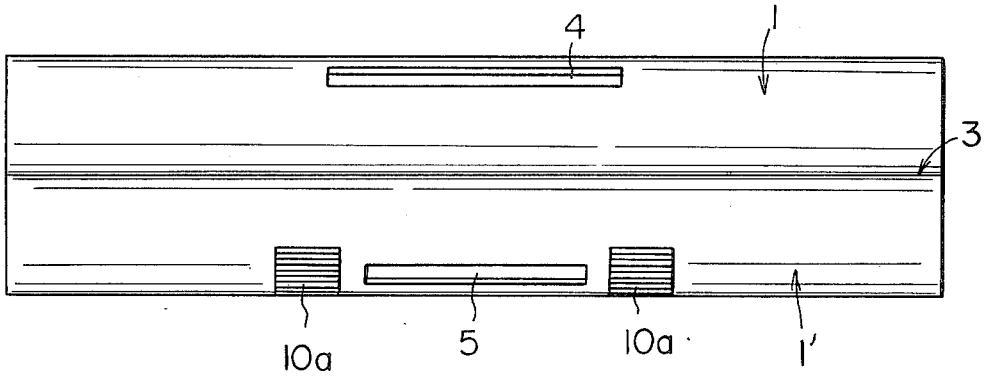
Fig. 2
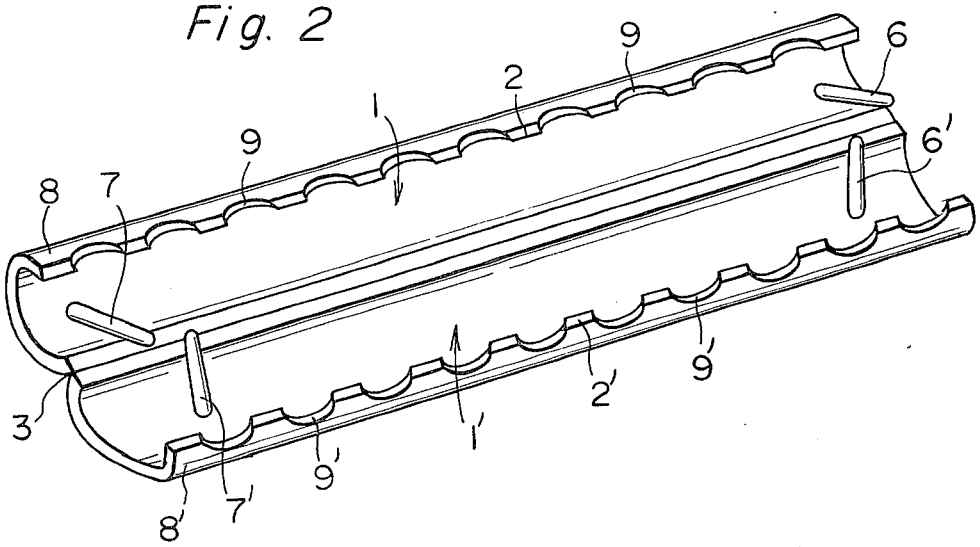
Fig. 4
Fig. 3
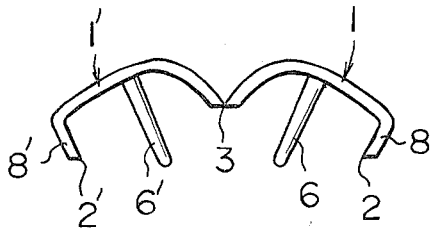
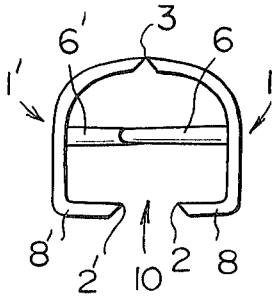

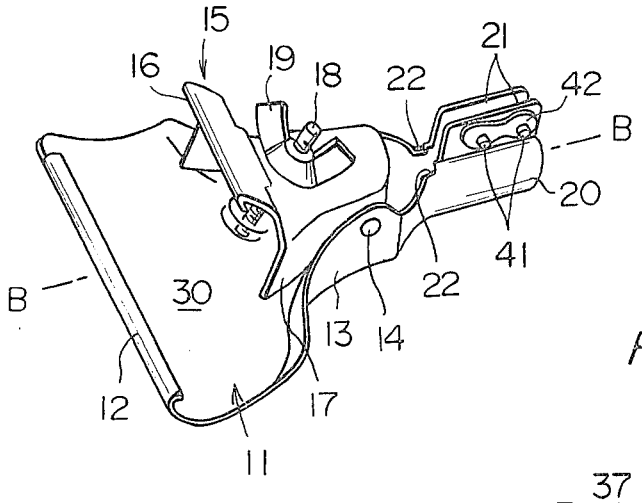
Fig. 5-A
Fig. 5-B
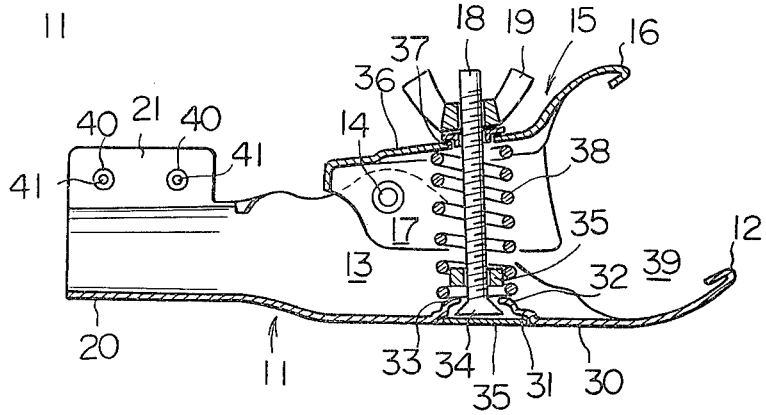
Fig. 6
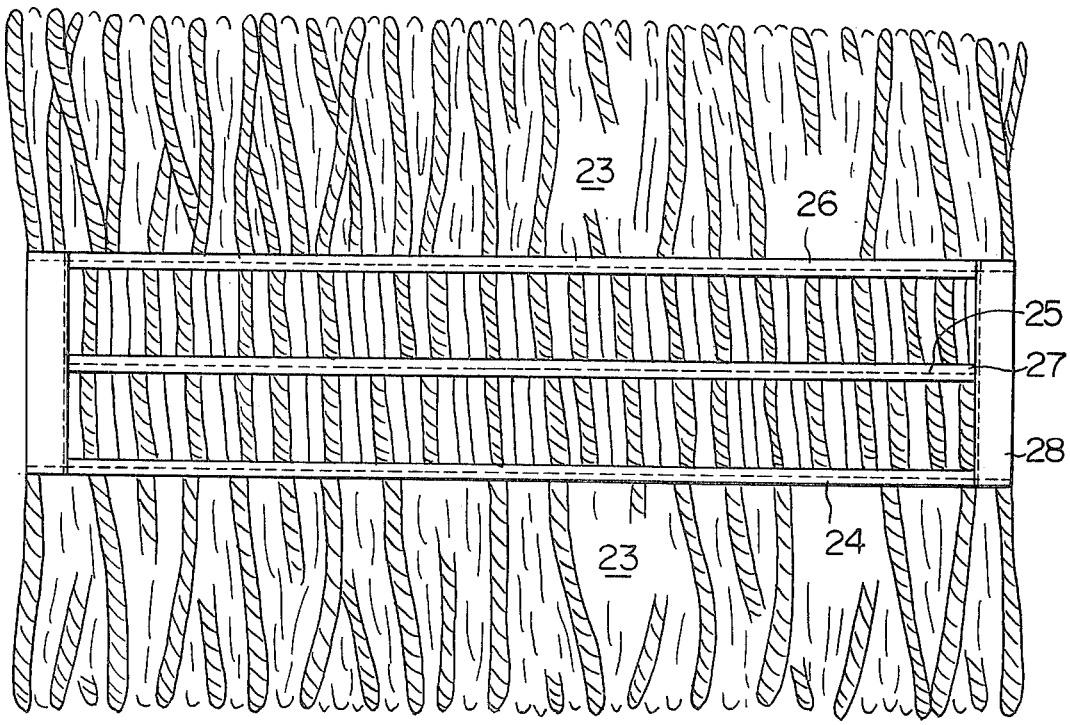

MOP HOLDER

DETAILED DESCRIPTION OF THE INVENTION

The present invention relate to a mop holder of a very simple construction, and more particularly to a dusting mop holder having a simple construction and having a high utility, which comprises a plastic holding member which very easily and strongly holds a mop composed of mop cords that are arrayed in a plane in a certain direction and sewed as a single unit, to thereby keep the holding state stably, and a clamp member or a linking member that is linked to the other end of the holder having a grip at one end.

Many cleaning tools having a floor-dusting or polishing mop at the lower end of the holder have been known in the art. However, many of these known cleaning tools have some deficiencies. For example, the construction of the mop holder is complex and its production requires troublesome steps, or the construction of the holder is simple but attaching or detaching of the mop is not easy, or the holder or frame is not capable of firmly holding the mop and is not suited for cleaning jobs.

I have continued research with a view to providing a dusting mop that is free of deficiencies involved in the conventional mop cleaning tools, and I have now invented an excellent mop holder of a simple construction by utilizing such properties as strength and flexibility of certain synthetic resins.

That is, an object of the present invention is to provide a holder of a very simple construction having a high mop-holding force.

Another object of the invention is to provide a holder to which a mop can easily be attached and from which the mop can easily be detached, and to provide a clamp member to be used in combination with said holder.

A further object of the invention is to provide a dusting mop which can be manufactured easily, which is light in weight and by use of which dusting operation can be performed very easily.

Yet further objects and advantages of the present invention will become clear from the following description.

In accordance with the present invention, there is provided a mop holder comprising a holding member for holding a mop formed of a synthetic resin having a high resistance to folding, a handle shaft and a linking member for linking said holding member to the handle; wherein said holding member comprises a pair of shell members integrally formed of said synthetic resin and extending in the lengthwise direction, a hinge that links said pair of shell members so that they can be opened and closed, a pair of teeth trains to hold the mop, and a plurality of anchoring pins provided inside said shell members; the outer surfaces of said shell members are convex, said hinge is thinner than said shell members, and flexible and extending in the lengthwise direction; said pair of teeth trains are provided at the end of an extension plate bent inwardly from said shell members at the lower edge opposite to the hinge of said shell members and over the entire lengthwise direction thereof, so that said pair of teeth trains are disposed to face each other; said anchoring pins are arranged in the vicinity of both edges, in the lengthwise direction, of said shell members to protrude toward the inside of said shell members, so that when said pair of shell members are closed, the anchoring pins provided on each of the shell members are engaged with the mop alternately; a recessed groove is formed on the outer surfaces of said pair of shell members near said lower edge and at the central part in the lengthwise direction, said recessed groove being in parallel to said lower edge so as to mount thereon the linking member; said linking member is equipped with a stop piece that will be inserted in one of said recessed grooves at the lower edge and includes a support member having a tightening-loosening tube into which will be inserted the handle shaft at the upper part, a bracket being pivotally attached to said support member and having at the lower edge a stop piece that will be inserted in the other said recessed groove, and a fastening mechanism provided on said support member and bracket to adjust the clearance between the stop piece of said support member and the stop piece of said bracket; said holding member is inserted in a space defined by said support member and said bracket, so that said teeth trains are positioned outwardly and said hinge is disposed inwardly in said space; said pair of stop pieces are fitted to said pair of recessed grooves, respectively; and wherein the mop is detachably fastened to said linking member by said fastening mechanism.

The structure and features of the mop holder according to the present invention will now be described in detail by reference to the accompanying drawings.

FIG. 1 is a plan view of a mop holding member, in which shell members are opened outwardly on both sides of a foldable thin layer, i.e., a hinge that is formed at the center and over the entire length of semicircular shell bodies of said shell members.

FIG. 2 is a perspective view as seen from the back of the holding member of FIG. 1.

FIG. 3 is a view, seen from the lengthwise direction, of the holding member of FIG. 1.

FIG. 4 is a view as seen from the lengthwise direction, in which the shell members on both sides of said foldable thin layer are made close inwardly to each other (the state in which the mop is held).

Figure 7:
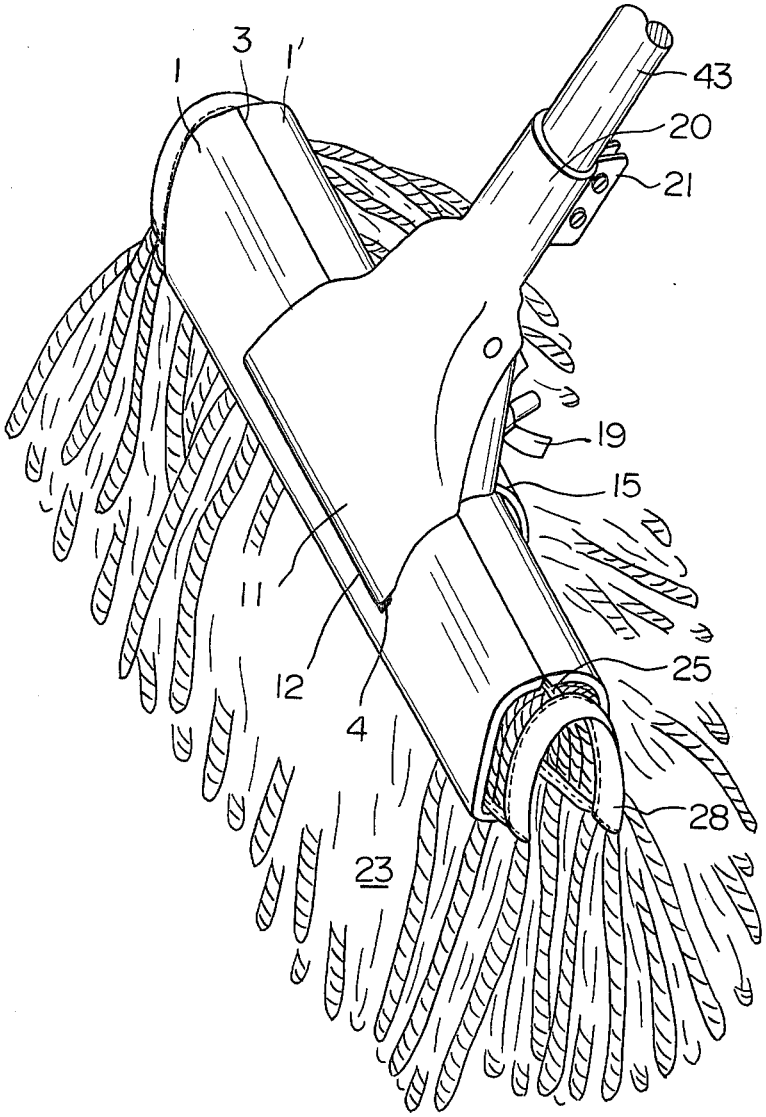

FIG. 5-A is a perspective view showing an example of a clamp member, i.e., a linking member that will be set as a single unit to the holding member.

FIG. 5-B is a view showing the section of the clamp member of FIG. 5-A taken along line B—B in FIG. 5-A.

FIG. 6 is a sketch of the mop (cords are sewed to a plate-like bundle) that is desirbly suited for the mop holder of the present invention.

FIG. 7 is a perspective view showing the state in which said mop, holding member, clamp member and mop shaft are assembled as a single unit.

The holding member for use in the present invention comprises, as shown in FIGS. 1 to 4, a pair of shell members 1, 1′ made of a synthetic resin having excellent resistance to folding, a hinge 3 that links a pair of shell members 1, 1′ so that they can be opened and closed, a pair of teeth trains 2, 2′ for holding the mop (see FIG. 7), and a plurality of anchoring pins 6, 6′, 7, 7′ that are provided inside said shells.

Each of shell members 1, 1′ has a convex outer surface and extends in the lengthwise direction, and these shell members 1, 1′ are linked together as a single unit via thin hinge 3 extending in the lengthwise direction and constitutes a main body of the holding member. In order to maintain the mop in good condition and facilitate the operation of attaching it to the linking member, it is desirable that the shell members 1, 1′ have a symmetrical structure with hinge 3 interposed therebetween and, when closed, they have a substantially U-shaped cross-section, as shown in FIG. 4.

It is also desirable that the thin resin layer that works as a hinge 3 is thin enough to form a flat inner surface when opened, as shown in FIG. 3, and to form a V-shaped groove in the state where its outer face is smoothly contacted to the outer surface of the shell members 1 and 2, when closed as shown in FIG. 4, whereby flexibility required for opening and closing a pair of shell members of the holding member is imparted to the hinge 3 and a spring force of always keeping a pair of shell members open is provided by the hinge 3.

Grooves 4 and 5 are formed on the lower outer faces of the shell members 1 and 2 that constitute a body at the center and in parallel to the lengthwise direction thereof. Said groove 4 may be about ½ to 3/10 of the length of the body, and the length of the groove 5 may be 1/2 to equal of the length of the groove 4. Usually, the ratio of the length of the groove 4 to the length of the groove 5 is advantageously from 3 to 2. Furthermore, to the lower edge of said shell members are bonded plates 8, 8′ over the entire length, said plates 8, 8′ being bent and extended inwardly at substantially right angles to the sides of the shell members 1, 1′. The plates 8, 8′, as shown in FIG. 4, have such width of extension as to define a clearance 10 when a cut-away cylinder is formed by the shell members 1 and 2. Said extension plates 8, 8′ also have a number of arcuate recesses 9, 9′ disposed at prescribed intervals over the entire edge and at the opposing positions, and among these recesses 9, 9′ are formed teeth 2, 2′. The teeth 2, 2′ have edges bevelled upwardly as shown in FIGS. 2 and 4. A pair of recess trains 9 and 9′ and a pair of teeth trains 2 and 2′ confront each other as shown in FIG. 2. When the shell members 1, 1′ are closed to form a mop path 10 (see FIG. 4) of a small clearance, narrow paths among the teeth 2, 2′ and broad paths among the recesses 9, 9′ are formed alternately, whereby the mop is held securely without deviation of the mop cord position. Further, as best shown in FIG. 2, the inwardly protruding anchoring pins 6, 7 and 6′, 7′ are formed inside the shell members 1 and 1′ along the lengthwise direction and in the vicinity of both ends thereof. In this case, it is necessary that the pins 6 and 6′ (7 and 7′) should have different distances and positions from the end and be facing each other when the shell members 1, 1′ are closed. For example, the distance difference should preferably be 1 to 1.5 cm. In the drawings, only one pin is provided on each end. In practice, however, two pins may be provided near both ends of the shell member 1 and, in this case, both ends of the shell member 1′ may have 2 to 3 pins disposed at positions different in the distance from the end or in the height. However, it is absolutely unnecessary to provide such pins on the grooves 4 and 5 on the outer surface the back surface of the shell members at corresponding positions in the vicinity of the two edges. The reason is that provision of such pins makes the manufacturing of the body and the mopmounting operation too troublesome and makes no contribution to increase of the stability of mop holding. Here, a holding part 10*a* composed of zig-zag projections may be provided on the outer surface of the shell member 1 or 1′ in order to ensure holding of the holding member when it is mounted on the mop holder or linking member (see FIG. 1).

In a mop holding member of the present invention having the aforementioned structure, said thin layer 3 must be made of a material that can function as a hinge capable of resisting repeated folding. Examples of materials having such property may include olefin copolymers composed mainly of polypropylene or propylene, resin blends thereof, and other thermoplastic resins and resin compositions that are capable of giving a so-called hinge function to said thin-layer hinge 3. Said holding member can be manufactured by any means employing a metal mold. For example, when a propylene-type material is employed, the injection molding will advantageously be used. It is advantageous to employ for example, a metal mold which will form all pins of the holding member in parallel.

Further, a widely known split mold may be used. In this case, the holding member is molded in a form as shown in FIGS. 2 to 3 and the molded holding member can easily be taken out from the mold.

FIGS. 5–A and 5–B show an example of a linking member, i.e., a clamp member that will be used in combination with the holding member. The clamp member shown has a construction somewhat resembling a clip that holds piled sheets of paper, and is composed mainly of a support member 11 and a bracket 15 which is pivotally attached to said support member 11. The support member 11 is formed by folding a metal plate and has at its upper part a tube 20 with a slit formed in the axial direction for holding a rod handle. The support member 11 also has at the other end a stop piece, i.e., a long pawl 12 that will be inserted into the groove 4 of said holding member. Said pawl 12 is formed by folding inwardly the top end portion of the plate along a length of about 2 to 3 mm from the top end at an angle of 180°, and has a width to match the length of said groove. Said folded edge is conveniently hooked to the side wall of the groove. Both sides at the central part of the plate 11 are erected toward the side of the bracket 15, i.e., toward the inside to form a pair of vertical plates 13, and penetrating holes (not shown) are provided at the opposing positions of said vertical plates, and a pivot pin 14 is secured at both ends to said penetrating holes. The bracket 15 is also formed by holding a metal plate, and it has at its lower part a stop piece, i.e., a pawl 16 that will be inserted into said groove 5 like said pawl 12. Both sides at the central part of the plate forming a bracket 15 are also bent at right angles inwardly like the plate 11, and pivot pin 14 is inserted in two penetrating holes that positioned on both sides and at the upper part of the folded parts 17.

As best shown in FIG. 5-B, a shallow inwardly directed recess 31 and a deep recess 32 positioned at the center of said shallow recess 31 are formed at the center of a flat part 30 of the support member 11. At the center of the deep recess 32 is further provided a hole 33 for receiving therein a bolt 18. The head 34 of the bolt 18 is fitted to said deep recess 32, and the bolt 18 is swingably secured to the flat part 30 of the support member by means of head 34 and nut 35. Deep recess 32 of the support member 30 and bolt head 34 have oblong and dissimilar cross sections in the plain direction, so that the support member 30 and the bolt 18 will not rotate respective to each other.

On the upper surface of shallow recess 31 of the support member 30 may be printed a trademark or a service mark, and to the lower surface thereof may be attached the covering 35 made of paper, aluminim foil, plastic film or a laminate thereof to which a pressure-sensitive adhesive agent has been applied, so that the surface of the covering 35 is in flush with the outer surface of the flat part 30.

The flat part 56 of the bracket 15 is also provided with a hole 37 for inserting bolt 18 therein and a butterfly nut 19 is screwed into the bolt 18 which extends through said hole 37. A coil spring 38 is provided around the bolt 18 and between the inner surface of the support member 11 and the inner surface of the bracket 15, so that said coil spring 38 gives a force to expand the distance between the stop piece 12 of the support member 11 and the stop piece 16 of the bracket 15. If the butterfly nut 19 is turned clockwise, the distance between the pair of stop pieces 12 and 16 becomes narrow, and if the butterfly nut 19 is turned counterclockwise, the distance between the pair of stop pieces 12 and 16 becomes wide, thereby making it possible to adjust the distance between said pair of stop pieces.

According to the present invention, it is essential to form a sufficient space 39 between the top of support member 11 and the vertical part 13 and between the tip of bracket 15 and the vertical part 17, for insertion of said holding member. As best shown in FIG. 5–B, the space 39 has a U-shaped cross-section and the size should be greater than, or nearly equal to, the cross section of the holding member. This size is determined appropriately depending upon the opening degree of the clamp member (linking part) and the holding member.

The tube 20 for holding the handle is formed at the upper part of the support member 11 and has a slit in the axial direction of the tube for facilitating insertion of the handle end and for firmly holding the same. A pair of flanges 21, 21 are formed on the tube 20 to protrude outwardly in parallel to each other from the end of the slit. Said two flanges 21, 21, respectively, have two penetrating holes 40, 40 at parallel positions in the lengthwise direction of the tube, so that the tube is tightened or loosened by the two screws 41, 41. In this case, a plate having two threaded holes 40, 40 to fasten the male screws 41 can be used practically and advantageously to firmly fasten the handle shaft 43 (FIG. 7). Moreover, at the bottom of said tube 20 are usually provided a pair of stop hooks 22, 22 to define the lower end of the handle. The clamp member shown is made of a metal and can easily be made from a metal plate. The clamp member may also be made of a plastic material and the flexibility of the plastic material may be utilized to cause the clamp member to exhibit the intended function. In view of the strength and durability, it is preferred that the clamp member be made of a metal.

The mop to be used for the mop holder of the present invention may include a train of mop cords or strands composed of twisted yarns that are sewed in a plate form. FIG. 6 shows an example of the mop. Preferably, the mop may consist of cords 23 cut to a determined length, arrayed in parallel to one another and in a plate form in the lateral direction with both ends trimmed, and sewed at three stitche lines 24, 25 and 26, which are spaced from one another in the vertical direction so as to cross the cords at their central portions. Usually, three to five cords are piled and arrayed in a plate form and are sewed by placing a narrow cloth tape 27 on the upper and lower surfaces of the cord bundle. Another cloth 28 is also used to cover the three stitched ends, and the inner side of said cloth is sewed. It is desirable that the two outer stitch lines 24 and 26 are positioned at the teeth 2, 2' at the edges of said extension plates 8, 8' that directly press the mop, when the mop is sufficiently inserted and held inside of the body of the holding member of the present invention, as shown in FIG. 7. Accordingly, the distance between the stitch lines 24 and 26 is inevitably determined by the size of the holding member. Further, the length of the mop in the stitched direction should be a little longer than the length of the holding member; when the mop is held, the mop should exceed by about 1 to 3 cm beyond the two sides of the holding member in the lengthwise direction.

To set the mop, the mop is folded into two along the central line in the stitching direction, pressed into the holding member which is open as shown in FIG. 3, and inserted so that the pins 6, 6', 7, 7' will bite into the cord train. Then, the shell members 1, 1' are closed, and the mop is inserted in the space 39 of said clamp member so that the mop cords 23 will be directed outwardly with the hinge 3 of the holding member being inwardly directed, and then, pawls 12 and 16 of the clamp member are inserted into the grooves 4 and 5, followed by tightening of the screw 19. When the mop is in the set state, the holding member holds the mop very firmly at the portions that are strongly pressed by the pawls 12 and 16 of the clamp member, but outside the pawls, the holding force is decreased a little as the mop is held by a special material such as polypropylene which has flexibility. The anchoring pins 6, 6', 7, 7' provided near the ends of the body, however, sufficiently reinforce the mop holding force. Therefore, it is unnecessary to make said holding pawls large enough to span over the full length of the body of the holding member. Thus, these anchoring pins have a very practical utility.

Furthermore, on the pair of extension plats 8, 8', teeth 2 (2') and recesses 9 (9') are alternately disposed to confront each other. Therefore, the train of cords 23 is firmly held because the position of the holding member is not deviated.

The distance between the stop pieces 12 and 16 of the clamp member ia adjusted by turning butterfly nut 19, thus, making it possible to freely adjust the holding force of the mop. And in either case, since a spring force has been exerted across a pair of shell members 1, 1' in the opening direction, the engagement between the stop pieces 12, 16 and grooves 4, 5 is maintained stably.

As is seen from the foregoing illustration, the mop holder of the present invention is simple in the structure and consists of a holding member that can be prepared easily from a thermoplastic resin having particular properties and a linking member which, being attached to said holding member, firmly holds the mop and links itself to the handle rod for cleaning operation, and is therefore very practicable, making easy attaching and detaching of the mop.

The mop to be used being held by the mop holder of the present invention will be impregnated with a dusting oil composition. Such an oil composition is known in the art and it generally comprises a mineral oil, a small amount of a cationic surfactant or amphoteric surfactant, or nonionic surfactant, and auxiliary components such as a perfume, a fungicidal agent, a sterilizing agent, etc. Mop cords may usually be made of twisted yarns of cellulose fibers such as cotton and rayon. Attaching and detaching of the mop impregnated with a dusting oil composition can easily be peformed without staining hands, when the structure of the present invention is used.

What is claimed is:

1. A mop holder comprising a holding member for holding a mop formed of a synthetic resin having a high resistance to folding, a handle shaft and a linking member for linking said holding member to the handle; wherein said holding member comprises a pair of shell members integrally formed of said synthetic resin and extending in the lengthwise direction, a hinge that links said pair of shell members so that they can be opened and closed, a pair of teeth trains to hold the mop, and a plurality of anchoring pins provided inside said shell members; the outer surface of said shell members being convex, said hinge being thinner than said shell members, and flexible and extending in the lengthwise direction; said pair of teeth trains being provided at the free edges of extension plates bent inwardly from said shell members at the lower edge opposite to the hinge of said shell members and over the entire lengthwise direction thereof, so that said pair of teeth trains are disposed to face each other; said anchoring pins being arranged in the vicinity of both ends, in the lengthwise direction, of said shell members to protrude inwardly of said shell members, so that when said pair of shell members are closed, the anchoring pins provided on each of the shell members engage with the mop alternately; a recessed groove on the outer surface of each of said pair of shell members near said lower edge and at the central part in the lengthwise direction, a said recessed groove being in parallel to said lower edge so as to mount thereon a linking member; said linking member being equipped with a stop piece that is inserted in said recessed groove at the lower edge and includes a support member having a tightening-loosening tube into which is inserted the handle shaft at the upper part, a bracket being pivotally attached to said support member and having at the lower edge a stop piece that will be inserted in the other of said recessed grooves, and a fastening mechanism provided on said support member and bracket to adjust the clearance between the stop piece of said support member and the stop piece of said bracket; said holding member being inserted in a space defined by said support member and said bracket, so that said teeth trains are positioned outwardly and said hinge disposed inwardly in said space; said pair of stop pieces being fitted to said pair of recessed grooves, respectively; and wherein the mop is detachably fastened to said linking member by said fastening mechanism.

2. A mop holder according to the claim 1, wherein a thin resin layer that forms the hinge of said holding member is so thin that a flat surface is formed inside thereof when a pair of shell members are opened, a V-shaped groove is formed when said pair of shell members are closed, and that the outer surface thereof is smoothly connected to the outer surface of said pair of shell members.

3. A mop holder according to claim 2, wherein said holding member is resiliently biased in the direction to open said pair of shell members by means of said hinge.

4. A mop holder according to the claim 1, wherein said pair of shell members are symmetrical with respect to a hinge interposed therebetween, and have nearly a U-shaped cross-section when closed.

5. A mop holder according to the claim 1, wherein a number of arcuate recesses are formed at prescribed small intervals at the free edges of said extension plates and said teeth are formed among said recesses, each of said teeth having a V-shaped sharp tip.

6. A mop holder according to the claim 1, wherein said holding member is molded by the injection molding of an olefin copolymer which is composed principally of polypropylene or propylene.

7. A mop holder according to the claim 1, wherein the support member of said linking member includes its stop piece positioned at the lower edge formed integrally by folding a piece of metal, the tube positioned at the upper part thereof to receive the shaft, a central part and a pair of first vertical plates provided on both sides of said central part, each of said first vertical plates having a hole that is aligned to receive a pivot pin; the bracket of said linking member includes its stop piece positioned at the lower edge and formed by folding a piece of metal, a central part and a pair of second vertical plates provided on both sides of said central part, each of said second vertical plate having a hole that is aligned to receive said pivot pin; said support member and said bracket are pivotally linked together via said pivot pin; a deep recess which receives and holds the head of the bolt is provided at a central part of said linking member, and a hole through which will pass said bolt is provided at the bottom of said recess; said bolt is swingably fastened to the central part by means of the head of said bolt and a nut screwed on said bolt; a hole through which will pass said bolt is provided at the central part of said bracket, the bolt extending outwardly through said hole; a coil spring is provided encircling said bolt and between the central part of said support member and the central part of said bracket to open apart said two members; and an adjustment nut is fitted to the bolt positioned outside said bracket to adjust the distance between the stop piece of the support member and the stop piece of the bracket.

8. a mop holder according to the claim 7, wherein a shallow recess for receiving therein a sheet-like covering is provided around the deep recess of said support member, and said sheet-like covering adheres to said recess by a pressure-sensitive adhesive agent.

9. A mop holder according to the claim 7, wherein the tube of the support member for receiving the shaft has a slit in the axial direction thereof, a pair of flanges are provided integrally with said tube extending from the end of said slit outwardly at right angles and in parallel lines, two penetrating holes are provided on the flanges, said pair of flanges are fastened by a fastening mechanism so that they are tightened or loosened freely, and a pair of stop hooks are provided at the boundary between said tube and said central part to restrict the movement of the top end portion of the rod that will be inserted in said tube.

* * * * *